US005148652A

United States Patent [19]

Herzog

[11] Patent Number: 5,148,652

[45] Date of Patent: Sep. 22, 1992

[54] HAND CAPPER

[76] Inventor: Kenneth J. Herzog, 135 Industrial Blvd., Riverhead, N.Y. 11901

[21] Appl. No.: 655,537

[22] Filed: Feb. 14, 1991

[51] Int. Cl.[5] ..... B65B 7/28

[52] U.S. Cl. ..... 53/331.5; 53/390; 51/268

[58] Field of Search ..... 53/317, 318, 331.5, 53/363, 390; 51/268, 269, 272

[56] References Cited

U.S. PATENT DOCUMENTS

| | | | |
|---|---|---|---|
| 1,895,037 | 1/1933 | Herndon | 53/317 |
| 1,954,422 | 4/1934 | McIntyre | 53/363 X |
| 2,097,022 | 10/1937 | Donahue | 53/317 |
| 2,382,147 | 8/1945 | Hanak | 51/269 |
| 2,760,391 | 8/1956 | Knutson | 53/317 |
| 2,835,084 | 5/1958 | Fotre | 51/272 |
| 3,491,516 | 1/1970 | Bergeron | 53/317 |
| 4,222,215 | 9/1980 | Takano | 53/331.5 |
| 4,614,077 | 9/1986 | Muto et al. | 53/331.5 X |
| 4,793,120 | 12/1988 | Herzog | 53/331.5 |

*Primary Examiner*—Robert L. Spruill
*Assistant Examiner*—Daniel B. Moon

[57] ABSTRACT

A hand held capper that will engage a cap for tightening the cap onto a container is provided and includes a clutch mechanism that will sense the torque between the cap and a neck of the container and will allow a cap driver chuck with an elastic chuck insert thereon to stop rotating once the desired torque is reached while allowing a spindle shaft from a drive unit to continue to rotate.

3 Claims, 1 Drawing Sheet

HAND CAPPER

BACKGROUND OF THE INVENTION

The instant invention relates generally to screw capping machines and more specifically it relates to a hand held capper which provides a mechanism which is held by the hand for safely tightening caps onto containers.

There are available various conventional screw capping machines which do not provide the novel improvements of the invention herein disclosed.

SUMMARY OF THE INVENTION

A primary object of the present invention is to provide a hand held capper that will overcome the shortcomings of the prior art devices.

Another object is to provide a hand held capper that includes a mechanism which is held by a hand of a person that will safely tighten caps onto containers.

An additional object is to provide a hand held capper in which the mechanism is an adjustable clutch connected to a chuck with a chuck insert that engages with the caps being of any of various sizes.

A further object is to provide a hand held capper that is simple and easy to use.

A still further object is to provide a hand held capper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
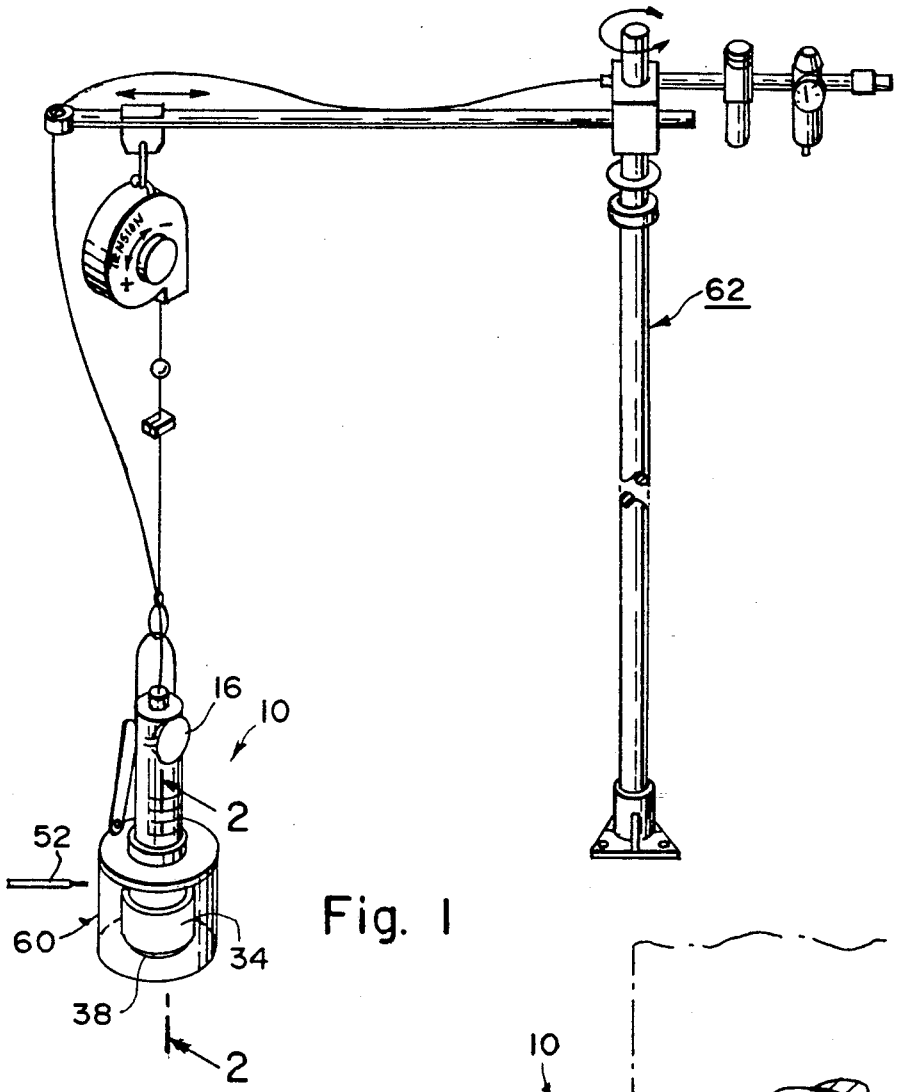
FIG. 1 is a perspective view of the invention attached to a balanced mounting suspension system.
Figure 2:
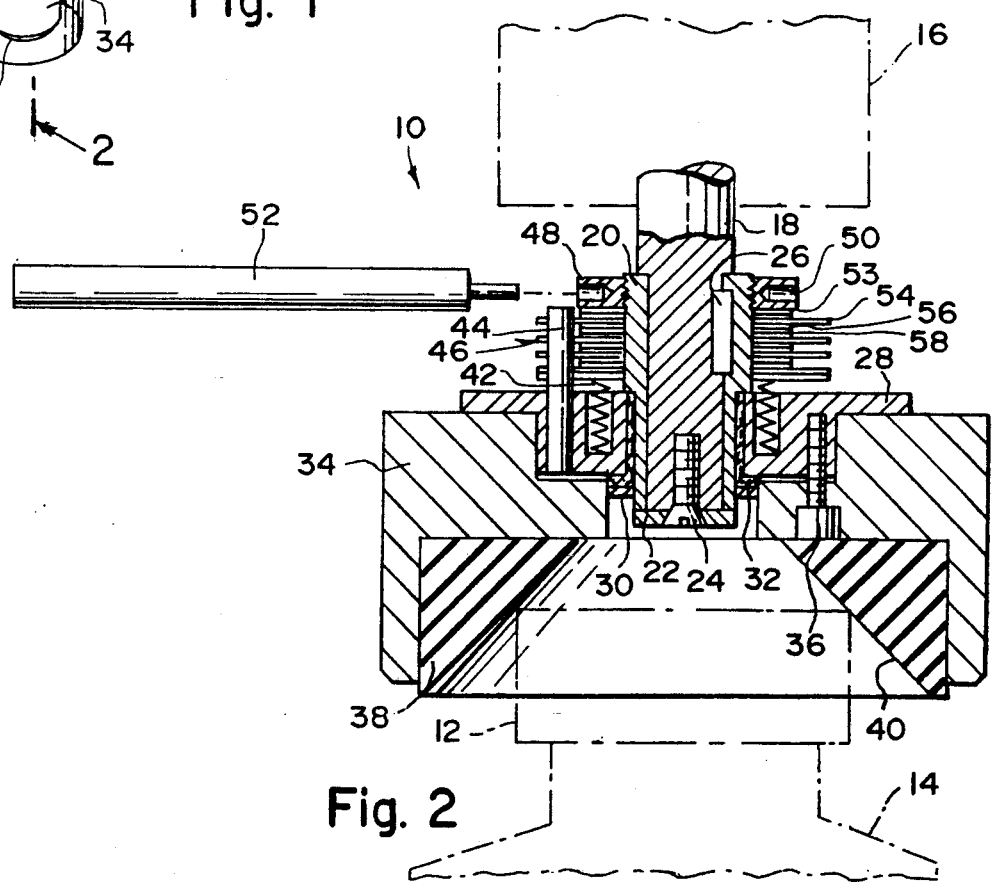
FIG. 2 is a cross sectional view taken along line 2—2 in FIG. 1 with the drive unit, bottle and cap shown in phantom.

Turning now descriptively to the drawings, in which similar reference characters denote similar elements throughout the several views, the Figures illustrate a hand held capper 10 that will engage a cap 12 for tightening the cap onto a container 14. The hand held capper 10 consists of a pneumatic or electric drive unit 16 having a spindle shaft 18, whereby the drive unit 16 is held and operated by the hand of a person so as to rotate the spindle shaft 18. A clutch hub 20 is retained by a washer 22 and flat head screw 24 and is keyed at 26 onto the spindle shaft 18 which prevents movement circumferentially between the hub 20 and the shaft 18.

A flange member 28 is carried on a bottom end of the clutch hub 20 by a retaining ring 30 and is rotatable thereabout by a bushing 32. A cap driver chuck 34 is attached to the bottom of the flange member 28 by a plurality of socket head screws 36. An elastic chuck insert 38 is disposed within said cap driver chuck 34. The chuck insert 38 has a tapered aperture 40 therein for engagement with the cap 12 being of any of various sizes. A plurality of springs 42 are disposed about and into the top of the flange member 28, while a plurality of torque pins 44 are disposed about and into the top of the flange member 28. A friction plate assembly 46 is disposed over the clutch hub 20 to sit upon the springs 42 and in engagement with the torque pins 44. An adjusting nut 48 is threadable onto a top portion of the clutch hub 20 and is bearable onto the top of the friction plate assembly 46 so that the friction plate assembly 46 can provide torque to the torque pins 44 and into the flange member 28. The adjusting nut 48 has a plurality of side apertures 50 therein. The clutch adjusting tool 52 is for engagement with one of the side apertures 50 in the adjusting nut 48 for turning the adjusting nut 48 to change tension therebetween, thus varying pressure from the clutch hub 20 through the friction plate assembly 46, through the flange member 28, through the cap driver chuck 34 and into the chuck insert 38 which will sense the torque between the cap 12 and the neck of the container 14 and will allow the cap driver chuck 34 to stop rotating once the desired torque is reached while allowing the spindle shaft 18 from the drive unit 16 to continue to rotate.

The friction plate assembly includes a dimple ratchet plate 53, a plurality of large plates 54, a plurality of small plates 56 and a plurality of friction pads 58. The dimple ratchet plate 53, the large plates 54, the small plates 56 and the friction pads 58 are disposed over the clutch hub 20 in a stacked relationship. Generally the dimple ratchet plate 53 has dimples which bear on said small plates 56 which in turn bears on said friction pads 58 which bears on the large plates 54 which are in engagement with said torque pins 44 so as to provide rotation of torque pins 44 and better dissipation of heat due to friction between the friction pads 58 and better distribution of rotational torque to the torque pins 44, as described in U.S. Pat. No. 4,793,120.

The hand held capper 10 further includes a cup shaped transparent safety shield 60 affixed to the bottom of the drive unit 16 so as to extend downward over the cap driver chuck 34 to protect the person operating the hand held capper 10 from splashing, debris and the like. The hand held capper 10 further includes a balanced mounting suspension system 62 connected to the drive unit 16 to minimize operating fatigue to the person operating the hand held capper 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hand held capper that will engage a cap for tightening the cap onto a container, said hand held capper comprising:

a) a drive unit having a spindle shaft whereby said drive unit is held and operated by the hand of a person so as to rotate said spindle shaft;

b) a clutch hub retained and keyed onto said spindle shaft which prevents movement circumferentially between said hub and said shaft;

c) a flange member carried on a bottom end of said clutch hub and rotatable thereabout;

d) a cap driver chuck attached to the bottom of said flange member;

e) an elastic chuck insert disposed within said cap driver chuck, said chuck insert having a tapered aperture therein for engagement with the cap being of any of various sizes;

f) a plurality of springs disposed about and into the top of said flange member;

g) a plurality of torque pins disposed about and into the top of said flange member;

h) a friction plate assembly disposed over said clutch hub to sit upon said springs and in engagement with said torque pins;

i) an adjusting nut threadable onto a top portion of said clutch hub and bearable onto the top of said friction plate assembly so that said friction plate assembly can provide torque to said torque pins, and into said flange member, said adjusting nut having a plurality of side apertures therein; and j) a clutch adjusting tool for engagement with one of said side apertures in said adjusting nut for turning said adjusting nut to change tension therebetween thus varying pressure from said clutch hub through said friction plate assembly, through said flange member, through said cap driver chuck and into said chuck insert which will sense the torque between the cap and the neck of the container and will allow said cap driver chuck to stop rotating once the desired torque is reached while allowing said spindle shaft from said drive unit to continue to rotate; wherein said friction plate assembly includes:

k) a dimple plate with a dimpled bearing surface;

l) a plurality of large plates;

m) a plurality of small plates; and n) a plurality of friction pads, whereby said dimple plate, said large plates, said small plates and said friction pads are disposed over said clutch hub in a stacked relationship in which generally said dimple plate sits on top, one of said small plates sits between two of said friction pads, which sits between two of said large plates which are in engagement with said torque pins so as to provide better torque transmission and dissipation of heat due to friction between said friction pads and better distribution of pressure to said torque pins.

2. A hand held capper as recited in claim 1, further including a cup shaped transparent safety shield affixed to the bottom of said drive unit so as to extend downward over said cap driver chuck to protect the person operating said hand held capper.

3. A hand held capper as recited in claim 2, further including a balanced mounting suspension system connected to said drive unit to minimize operating fatigue to the person operating said hand held capper.

* * * * *